US006357208B1

(12) United States Patent
Spatafora

(10) Patent No.: US 6,357,208 B1
(45) Date of Patent: Mar. 19, 2002

(54) METHOD OF FEEDING COLLARS TO A CONTINUOUS PACKING LINE FOR PRODUCING RIGID PACKETS OF CIGARETTES

(75) Inventor: Mario Spatafora, Bologna (IT)

(73) Assignee: G.D Societa' Per Azioni, Pompomia (IT)

( * ) Notice: Subject to any disclaimer, the term of this patent is extended or adjusted under 35 U.S.C. 154(b) by 0 days.

(21) Appl. No.: 09/470,387

(22) Filed: Dec. 22, 1999

(30) Foreign Application Priority Data

Dec. 22, 1998 (IT) ..... BO98A0707

(51) Int. Cl.[7] ..... B65B 11/28; B65B 61/20; B65B 19/02

(52) U.S. Cl. ..... 53/415; 53/452; 53/466; 53/136.1; 53/234; 53/389.3

(58) Field of Search ..... 53/397, 410, 415, 53/234, 136.1, 452, 466, 588, 207, 389.3; 493/81, 94, 359, 360, 911

(56) References Cited

U.S. PATENT DOCUMENTS 3,967,543 A * 7/1976 Seragnoli ..... 493/94
5,163,268 A 11/1992 Vaccari et al.
5,657,609 A * 8/1997 Spada et al. ..... 53/415 X
5,782,736 A * 7/1998 Brizzi et al. ..... 493/84 X
6,000,196 A * 12/1999 Boldrini et al. ..... 53/415 X

FOREIGN PATENT DOCUMENTS

DE 601 697 C 8/1934

* cited by examiner

*Primary Examiner*—Stephen F. Gerrity
(74) *Attorney, Agent, or Firm*—Marshall, Gerstein, & Borun

(57) ABSTRACT

In a unit for feeding collars to a continuous packing line for producing rigid packets of cigarettes, a continuous strip is cut by a knife, at a cutting station, into a succession of collars which are picked up continuously by respective pickup members, each of which is swung with the knife to grip a collar, just cut off the strip, between the knife and the respective pickup member.

11 Claims, 5 Drawing Sheets

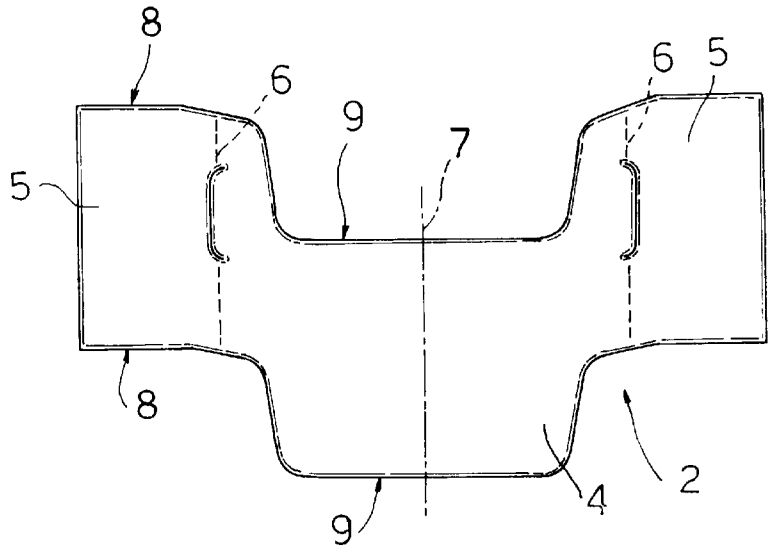
Fig.2
Fig.3
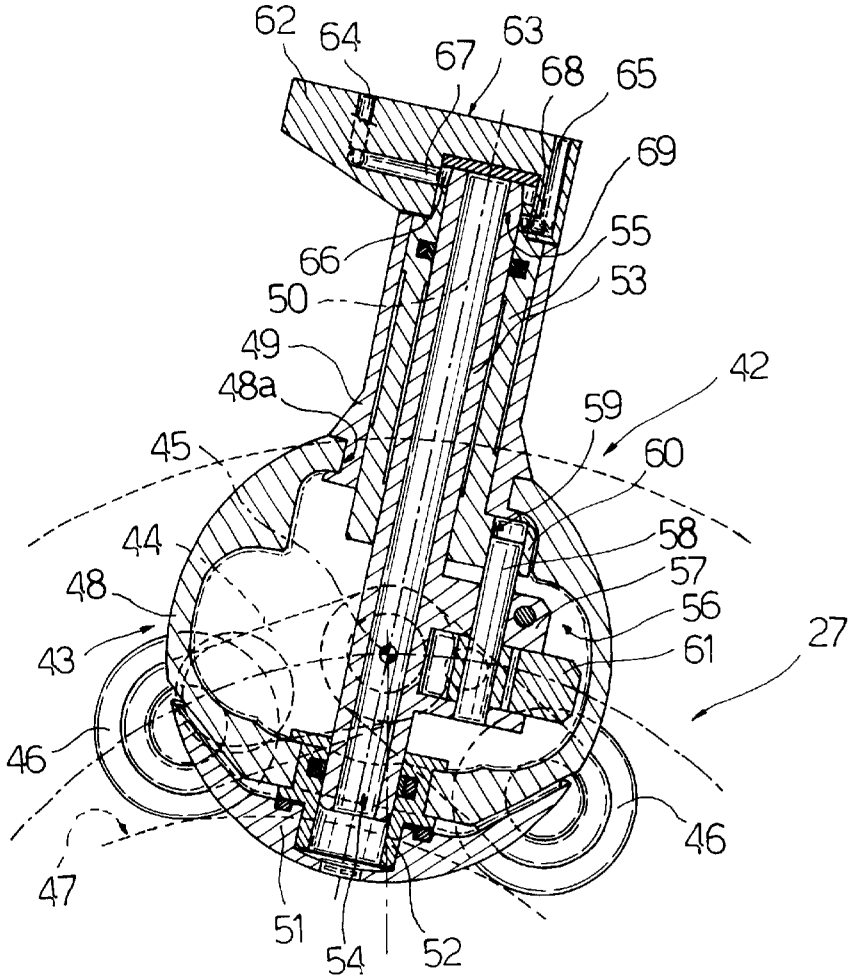

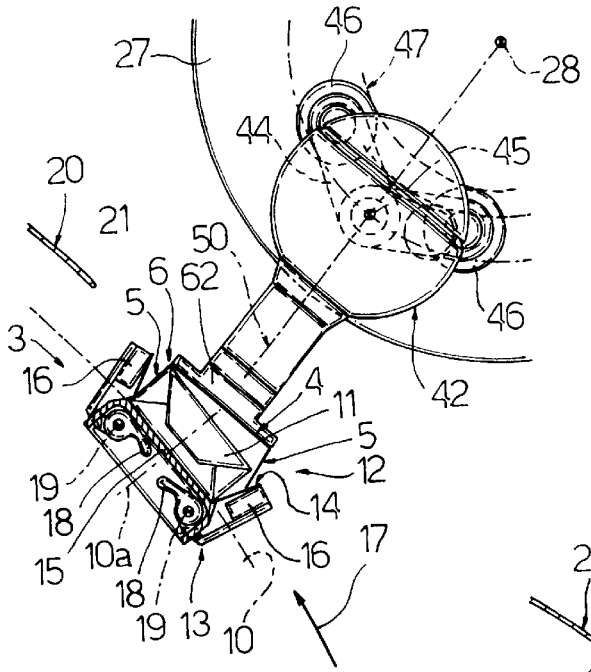
Fig.9
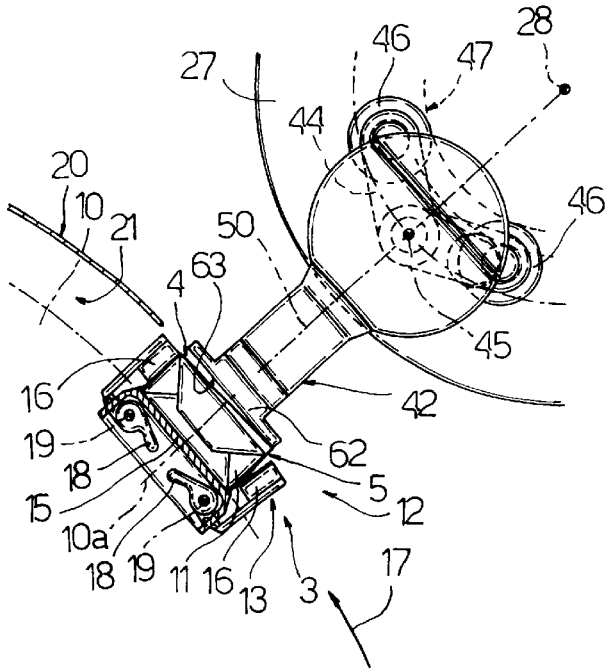
Fig.10
Fig.11
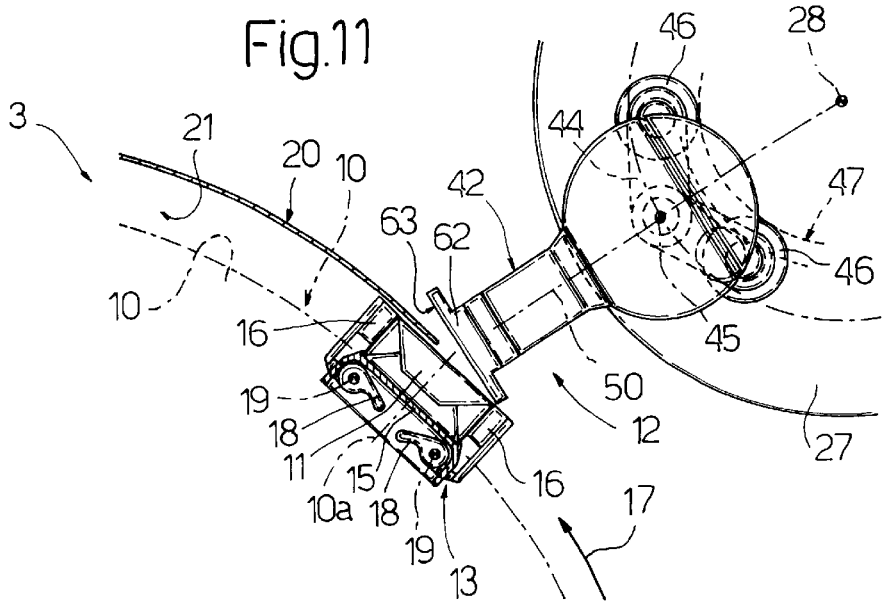

METHOD OF FEEDING COLLARS TO A CONTINUOUS PACKING LINE FOR PRODUCING RIGID PACKETS OF CIGARETTES

The present invention relates to a method of feeding collars to a continuous packing line for producing rigid packets of cigarettes.

BACKGROUND OF THE INVENTION

Machines for packing cigarettes in rigid packets are known to feature continuous packing lines comprising a pocket conveyor for continuously and successively feeding groups of cigarettes—wrapped in respective protective wrappings preferably of foil—through a collar supply station.

The collars are normally fed to the supply station by a supply unit comprising a feed assembly for feeding the collars in steps to a pickup station in a direction perpendicular to a major dimension of the collars. The supply unit also comprises a transfer wheel rotating continuously about a respective axis, and from the periphery of which extend outwards a number of transfer arms, each for transferring a respective collar from the pickup station to the supply station. When transferring the respective collar, each transfer arm moves through a folding station where the lateral wings of the collar are folded squarely with respect to a central panel of the collar. Each transfer arm is then rotated 90° about a respective longitudinal axis to feed the respective collar through the supply station in a direction parallel to said major dimension of the collar, and on to the respective group of cigarettes, which is fed through the supply station in a direction crosswise to a respective longitudinal axis.

Each known transfer arm normally comprises a base fitted to the periphery of the transfer wheel to rotate, with respect to the transfer wheel, about a respective axis parallel to the axis of the transfer wheel; a shaft fitted to the base to rotate, with respect to the base, about a respective longitudinal axis extending outwards from the transfer wheel in a substantially radial direction; and a pickup member for engaging a respective collar, and which is connected to a free end of the shaft to rotate, with respect to the shaft, about a respective axis parallel to the axis of the transfer wheel.

The collar feed assembly comprises a feed device for feeding a strip of cardboard in steps to a cutting station coinciding with the pickup station; and a cutting device for cutting the collars successively off the strip, and which normally comprises an anvil having a face coplanar with the strip, and a knife movable to and from the anvil to cut off the collars.

The complex articulated structure of the transfer arm is necessary to enable the respective pickup member to substantially stop at the pickup station long enough to safely pick up a respective collar, to cooperate with the continuous packing conveyor to transfer the collar to a respective pocket, and to rotate 90° about its own longitudinal axis between the folding station and the transfer station. In particular, when picking up the collar at the cutting station, the pickup member must be maintained for a given length of time substantially facing and contacting the collar to ensure precise, reliable pickup.

A collar supply unit of the type described above has several major drawbacks, both technical and economic, on account of the complex structure of each transfer arm.

SUMMARY OF THE INVENTION

It is an object of the present invention to provide a straightforward, low-cost method of transferring collars from a step-operated feed device to a continuous conveyor.

According to the present invention, there is provided a method of feeding collars to a continuous packing line for producing rigid packets of cigarettes, the method comprising a feed step to feed a strip in steps to a cutting station; a cutting step to cut said strip and obtain from the strip a succession of collars; and a transfer step to transfer the collars continuously to a packing wheel; and being characterized in that, during said cutting step, a cutting knife and a pickup member for picking up a said collar are swung in time with each other substantially about a same first axis and with concordant, substantially identical laws of motion, so that, at said cutting station, said cutting knife and said pickup member are maintained substantially contacting each other with, in-between, a said collar just cut off said strip.

According to a preferred embodiment of the above method, said pickup member comprises a pickup surface which is brought into contact with said collar; said pickup surface being perpendicular to a second axis, which is crosswise to said first axis and is maintained, during said cutting step, in a position substantially intersecting said first axis.

BRIEF DESCRIPTION OF THE DRAWINGS

A non-limiting embodiment of the invention will be described by way of example with reference to the accompanying drawings, in which:

FIG. 2 shows a plan view of a collar for a packet of cigarettes;

FIG. 3 shows a larger-scale view of a detail in FIG. 1;

FIGS. 4 to 11 show the FIG. 1 unit in different successive operating positions.

DETAILED DESCRIPTION OF THE INVENTION

Figure 1:
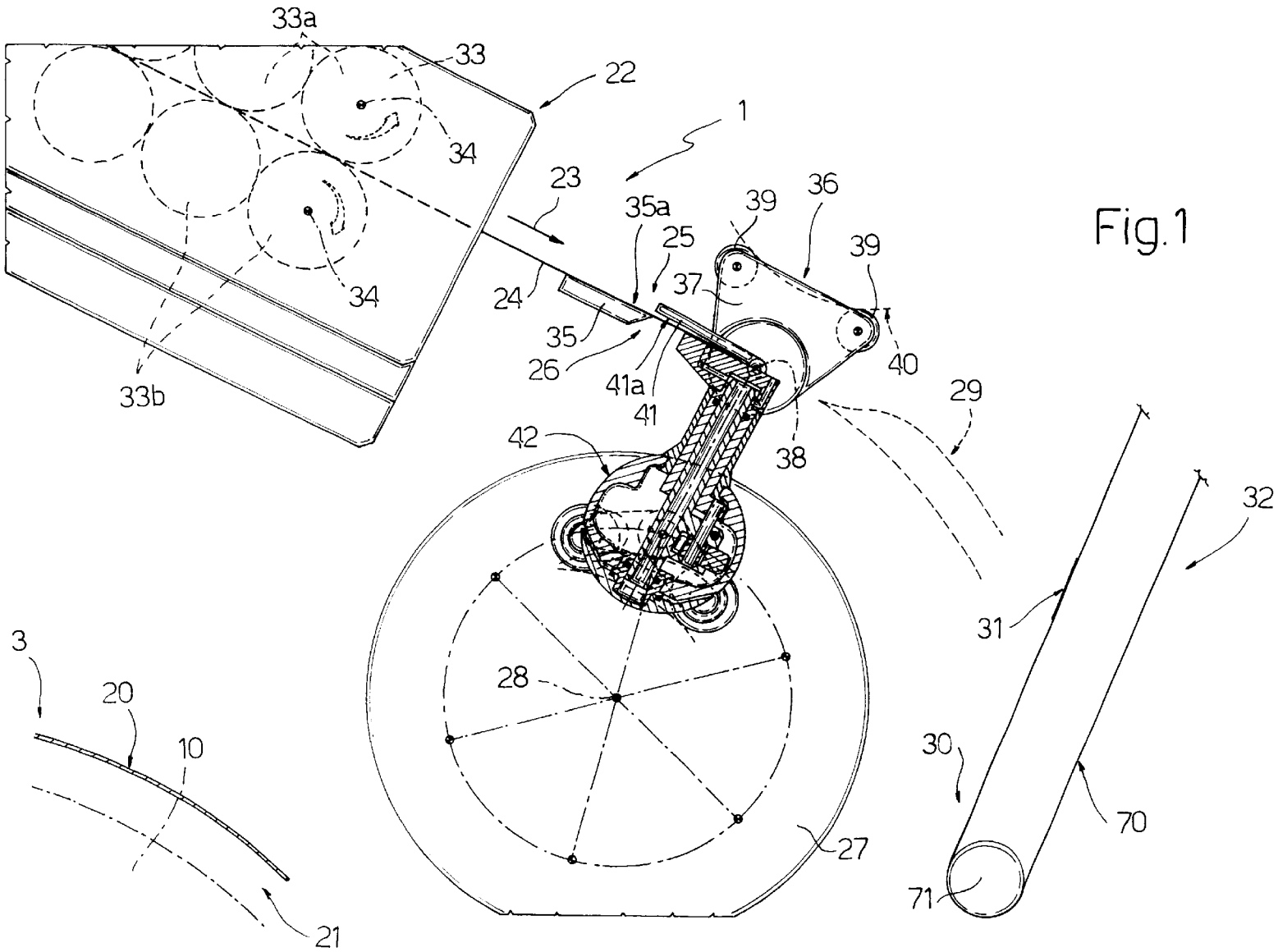
FIG. 1 shows a schematic side view, with parts in section and parts removed for clarity, of a preferred embodiment of a supply unit for implementing the method according to the present invention.

Number 1 in FIG. 1 indicates as a whole a supply unit for feeding collars 2 to a continuous packing line 3 for producing rigid, hinged-lid packets of cigarettes (not shown).

As shown in FIG. 2, each collar 2 comprises a central panel 4; and two lateral wings 5 located on opposite sides of panel 4 and connected to panel 4 along respective preformed bend lines 6 extending crosswise to a major dimension of collar 2 and parallel to a longitudinal axis of symmetry 7 of collar 2. Collar 2 also comprises two parallel edges 8 extending crosswise to axis 7 and having respective substantially U-shaped central portions 9.

As shown in FIGS. 8 to 11, line 3 comprises a packing wheel 10, which is powered in known manner (not shown) to rotate continuously about a respective axis (not shown) perpendicular to the FIGS. 8–11 planes, and to feed wrapped groups 11 of cigarettes successively to a supply station 12 for supplying collars 2.

Wheel 10 comprises a number of substantially U-shaped pockets 13 equally spaced along the periphery of wheel 10. Each pocket 13 is symmetrical with respect to a respective radius 10*a* of wheel 10, and has a concavity facing radially outwards to receive a respective cardboard blank 14, which is folded into a U and defines the outer package of a respective wrapped group 11 of cigarettes. Each pocket 13 comprises a bottom wall 15; and two lateral walls 16, which are located at the front and rear of bottom wall 15 in the traveling direction 17 of wheel 10, and are each defined by a respective arm of a respective rocker arm 18, which is rotated, by a known cam actuating deice (not shown) and about a respective axis 19 parallel to the axis of wheel 10, to a from a position (FIG. 11) gripping blank 14 and collar 2 about a respective wrapped group 11.

Packing line 3 also comprises a fixed retaining plate 20 coaxial with packing wheel 10 and defining, with wheel 10 a channel 21 for the passage of wrapped groups 11. Channel 21 extends downstream from supply station 12 and is of a width approximately equal to but no less than the thickness of a wrapped group 11, so that plate 20 permits the passage of wrapped groups 11 along channel 21, and also provides for keeping collars 2 in the correct position with respect to wrapped groups 11.

With reference to FIG. 1, unit 1 comprises a feed device 22 for feeding a strip 24 of cardboard in steps and in a longitudinal direction 23 to a cutting station 25 where a transverse cutting device 26 engages and cuts strip 24 into a succession of collars 2 oriented with axis 7 parallel to direction 23. Unit 1 also comprises a transfer wheel 27 fitted to a fixed support (not shown) to rotate continuously about a respective axis 28 parallel to the axis (not shown) of packing wheel 10.

Wheel 27 provides for picking up each collar 2 individually from cutting station 25, and for feeding the collar, firstly, to a folding station 29, where wings 5 of collar 2 are folded squarely with respect to respective panel 4, and then to a pickup station 30 where collar 2 is assigned a coupon 31. Wheel 27 then feeds collar 2 and the associated coupon 31 to supply station 12, and so orients collar 2 that, at station 12, axis 7 of collar 2 is parallel to the axis (not shown) of packing wheel 10.

Unit 1 also comprises a supply device 32 for successively feeding coupons 31 to station 30.

Device 22 for feeding strip 24 comprises a number of pairs of counter-rotating rollers 33 arranged successively in direction 23. Each pair of rollers 33 comprises two rollers 33*a* and 33*b* located on opposite sides of strip 24 and mounted for rotation about respective axes 34, parallel to axis 28, to feed strip 24 in steps to cutting station 25 in direction 23. Roller 33*a* is an idle pressure roller, and roller 33*b* a powered roller.

Cutting device 26 comprises an anvil 35 and a movable cutting member 36 located successively in the traveling direction 23 of strip 24. Anvil 35 is fixed and comprises a face 35*a* contacting strip 24 and having, at the end facing movable cutting member 36, a cutting edge reproducing one of edges 8 of collar 2. Cutting member 36 comprises a substantially triangular plate 37 located downstream from anvil 35 in direction 23, and mounted for rotation about a respectively substantially central axis 38 parallel to axis 28 and coplanar with face 35*a*. Plate 37 comprises, at its base, two tappet rollers 39 contacting the outer periphery of a cam 40, which provides for positively controlling the angular position of plate 37 about axis 38, and for swinging plate 37 about axis 38 according to a given law.

Plate 37 is fitted integrally with a knife 41, which has a surface 41*a* facing the periphery of transfer wheel 27 and tangent to axis 38. At the free end facing anvil 35, surface 41*a* has a cutting edge complementary to the cutting edge of anvil 35, and knife 41 swings with plate 37 with respect to anvil 35 to cut a collar 2 off strip 24 for each complete back-and-forth swing about axis 38.

Transfer wheel 27 comprises a number of transfer arms 42 equally spaced along the periphery of wheel 27 and extending outwards to each transfer a respective collar 2 from cutting station 25 to supply station 12.

As shown in FIG. 3, each arm 42 comprises a hollow frame 43, which is fitted integrally with a respective rocker arm 44 hinged to wheel 27 to rotate, with frame 43 and with respect to wheel 27, about a respective hinge axis 45 parallel to axis 28.

Each rocker arm 44 supports, at each end, a tappet roller 46 contacting the outer periphery of a cam 47 for positively controlling the angular position of rocker arm 44 and respective arm 42 about axis 45 to swing arm 42 about axis 45 according to a given law.

Frame 43 of each arm 42 comprises a substantially cylindrical bell 48 substantially coaxial with axis 45; a cylindrical sleeve 49 integral with bell 48, extending outwards from bell 48 through a hole 48*a* in bell 48, and having an axis 50 perpendicular to respective axis 45; and a counterweight 51 fitted to a sleeve 52 coaxial with sleeve 49 and extending through bell 48 in a position radially opposite sleeve 49.

A cylindrical tube 53 is fitted in axially-sliding manner through bell 48 and sleeve 49, is coaxial with axis 50, forms part of a pneumatic suction circuit 54, is connected directly in rotary and axially-sliding manner to sleeve 52, and is connected in rotary and axially-sliding manner to sleeve 49 via the interposition of a liner 55, which is coaxial with axis 50 and mates in rotary and axially-fixed manner with the inner surface of sleeve 49. Tube 53 and liner 55 are connected to each other in axially-sliding, angularly-fixed manner by means of a key device 56 comprising a fork 57 projecting radially outwards from the outer surface of tube 53, and a pin 58, which is parallel to axis 50, is integral with fork 57, and engages in axially-sliding manner a hole 59 formed through an appendix 60 extending radially outwards from the outer surface of liner 55. The portion of pin 58 extending through fork 57 is fitted with a tappet shoe 61 projecting from bell 48 towards cam 47, and engaging a track (not shown), formed on the face of cam 47 facing bell 48, to move tube 53 axially back and forth according to a given law, and to swing the assembly defined by tube 53 and liner 55 about axis 50 according to a further given law.

Liner 55 has an axial tubular appendix projecting outwards of sleeve 49 and fitted with a pickup head 62, which forms part of arm 42 and comprises, on the opposite side to that facing axis 45, a substantially flat pickup surface 63 perpendicular to axis 50 and separated from axis 45 by a distance which, if added to the distance between axis 45 and axis 28, is approximately equal to but no greater than the distance between axes 28 and 38. Two suction conduits 64 and 65, defining an input portion of suction circuit 54, come out at surface 63 and are located on opposite sides of a chamber 66 formed centrally in head 62 and engaged partially by liner 55. More specifically, conduits 64 and 65 are located the first behind the second in direction 23 when head 62 is located at cutting station 25, and communicate with chamber 66 through respective holes 67 and 68 offset axially along axis 50.

An end portion of tube 53 engages chamber 66 in sliding manner and defines a slide valve 69, which, moving axially towards sleeve 52, successively connects first hole 67 and then hole 68 with the inside of tube 53.

With reference to FIG. 1, device 32 for supplying coupons 31 comprises a conveyor belt 70 looped about two pulleys 71 (only one shown), one of which is powered, and both of which are fitted to a fixed support (not shown) to rotate continuously about respective axes parallel to axis 28. Device 32 retains coupons 31 on belt 70 by suction, and feeds the coupons successively, and a given distance apart, to pickup station 30, Operation of unit 1 will now be described relative to the supply of one collar 2 to continuous packing line 3, and with reference to FIGS. 1 and 4 to 11.

With reference to FIG. 1, feed device 22 feeds strip 24 forward one step in direction 23 towards cutting station 25, so that a length of strip 24 equal to a collar 2 projects beyond the cutting edge of anvil 35 and beneath knife 41, which is in a rest position over strip 24. At the same time, transfer wheel 27 feeds a respective transfer arm 42 towards cutting station 25, while cam 47 so orients arm 42 that, for a given time interval moving towards station 25, and for a further given time interval moving away from station 25, arm 42 is maintained at all times with axis 50 intersecting the axis of rotation 38 of knife 41.

As a consequence of the above, combined with said distances separating axis 38 and surface 63 from axis 28, pickup head 62, as it travels through cutting station 25 with axis 50 maintained intersecting axis 38, is maintained on the opposite side of axis 38 to knife 41, and rotates about an instantaneous axis of rotation, which is tangent to surface 63 and maintained substantially coincident with axis 38.

At this stage, slide valve 69 is set closing both holes 67 and 68.

Subsequently (FIGS. 4 and 5), cam 47 moves shoe 61 to slide tube 53 towards axis 45 and uncover hole 67, which thus communicates with the inside of tube 53 to enable pickup head 62 to engage by suction the portion of strip 24 projecting beyond anvil 35. At this point, cam 40 swings plate 37 about axis 38 so as to swing knife 41 through the path of strip 24 and so cut a collar 2 off strip 24.

Figure 5:
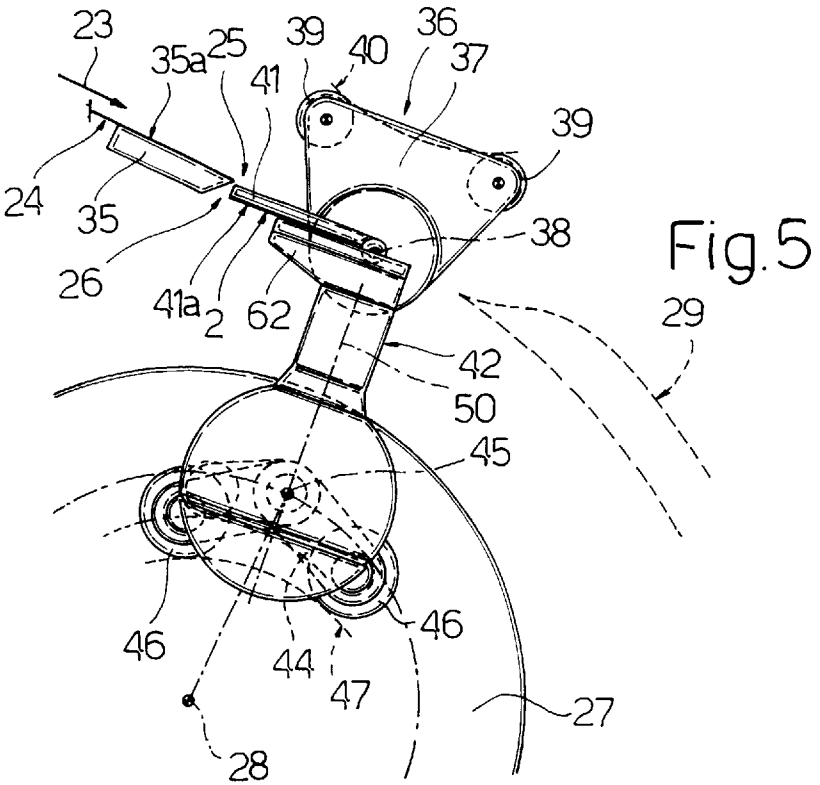
Figure 4:
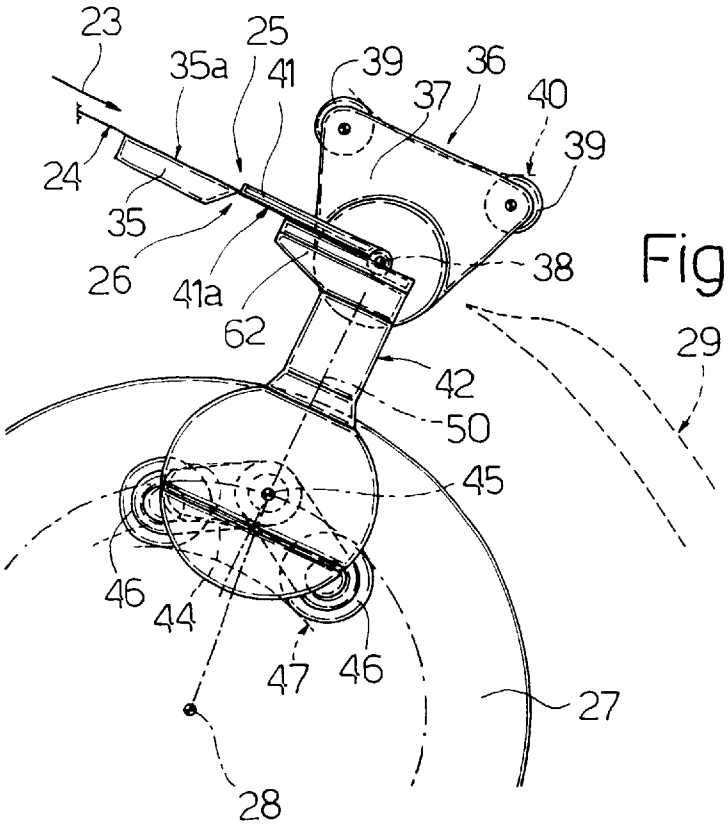

Cams 40 and 47 are designed to swing surface 63 and knife 41 about axis 38 in time with each other and with concordant, substantially identical laws of motion, so that, as shown in FIGS. 4 and 5, the anticlockwise swing imparted to knife 41 by respective cam 40 corresponds to a substantially identical anticlockwise swing of surface 63 by respective cam 47. Consequently, as pickup head 62 travels through cutting station 25, knife 41 is maintained substantially parallel to and substantially contacting surface 63 with, in between, the collar 2 just cut off strip 24.

Precise, reliable pickup of collar 2 by respective transfer arm 42 is therefore guaranteed by collar 2 being retained firmly by suction on surface 63, and, once detached from strip 24, being gripped between pickup head 62 and knife 41.

Figure 6:
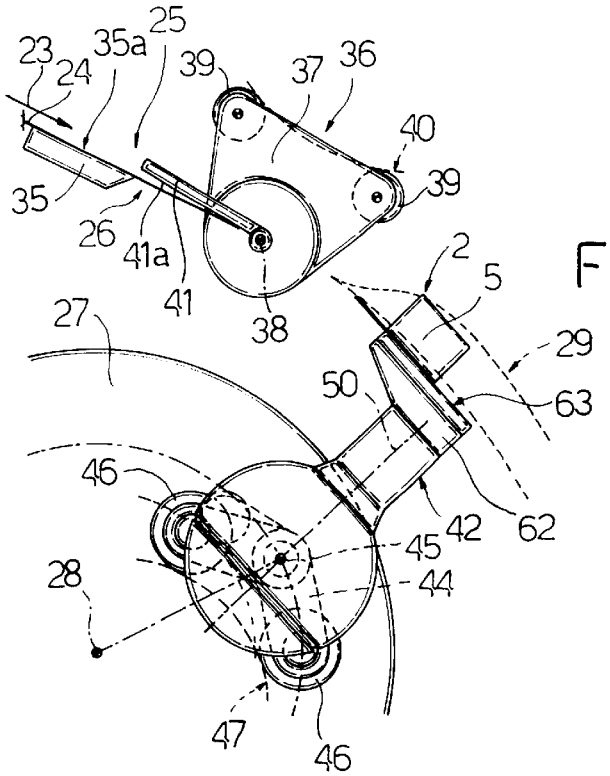
Figure 8:
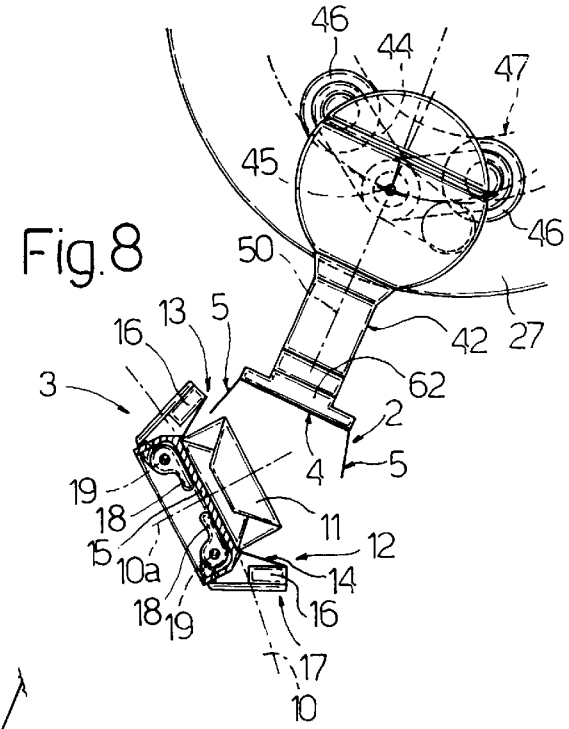
Figure 7:
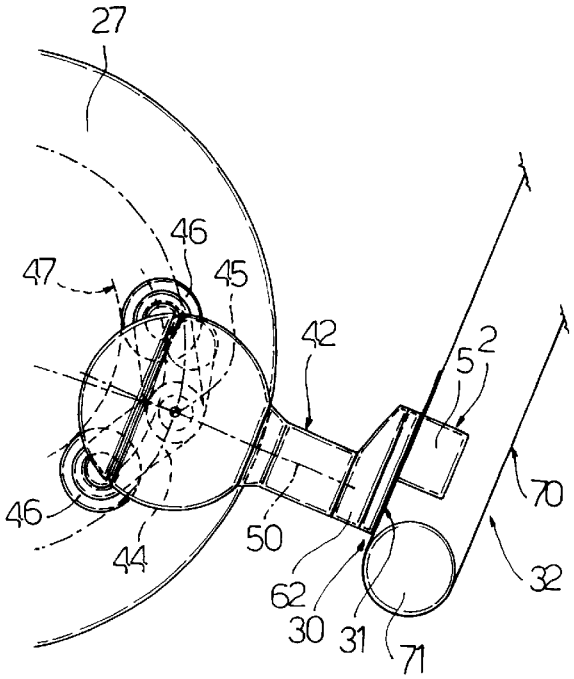

With reference to FIGS. 6 and 7, transfer arm 42 feeds respective collar 2 to pickup station 30 through folding station 29 where lateral wings 5 are folded substantially squarely with respect to respective central panel 4.

At pickup station 30, transfer arm 42 cooperates with supply device 32 to assign a respective coupon 31 to collar 2. In this connection, it should be pointed out that collar 2 picked up by transfer arm 42 at cutting station 25 only occupies a rear portion of surface 63 of pickup head 62, a front portion of surface 63, at which suction conduit 65 comes out, being exposed and therefore free to receive coupon 31.

As pickup head 62 engages pickup station 30, cam 47 moves shoe 61 to slide tube 53 towards axis 45 and so uncover hole 68, which thus communicates with the inside of tube 53 to enable pickup head 62 to retain coupon 31 by suction on surface 63.

Unlike cutting station 25, coupon 31 is transferred at pickup station 30 between two devices operating continuously at the same speed and in time with other, so that coupon 31 is transferred by suction from belt 70 to pickup head 62 with no difficulty.

Following pickup of coupon 31, cam 47 (FIG. 8) moves shoe 61 to rotate transfer arm 42 through 90° about axis 50 so that, at supply station 12, collar 2 is oriented with axis 7 parallel to the axis (not shown) of packing wheel 10.

With reference to FIG. 9, as it travels through supply station 12 in time with a respective pocket 13 with lateral walls 16 in the open position, transfer arm 42 is maintained by cam 47 in a substantially radial position with respect to transfer wheel 27, so as to gradually insert the front lateral wing 5 of collar 2 inside the gap between the front lateral wall of wrapped group 11 and a portion of blank 14 folded on to the front lateral wall 16 of pocket 13, and so that the front preformed bend line 6 of collar 2 coincides with a front outer edge of wrapped group 11.

With reference to FIGS. 10 and 11, once collar 2 and coupon 31 are transferred to respective pocket 13 of packing wheel 10, lateral walls 16 of pocket 13 are moved into the position gripping collar 2 and blank 14 about wrapped group 11, and cam 47 moves shoe 61 to slide tube 53 towards chamber 66 to close first conduit 65 and then conduit 64.

In connection with the above, it should be pointed out that knife 41 of unit 1 as described may be oriented about respective axis 38, so that pickup head 62 of each transfer arm 42 need not be orientable transversely with respect to the rest of transfer arm 42.

What is claimed is:

1. A method of feeding collars to a continuous packing line for producing rigid packets cigarettes, the method comprising a feed step to feed a strip (24) in steps to a cutting station (25); a cutting step to cut said strip (24) and obtain from the strip (24) a succession of collars (2); and a transfer step to transfer the collars (2) continuously to a packing wheel (10); and being characterized in that, during said cutting step, a cutting knife (41) and a pickup member (62) for picking up a said collar (2) are swung in time with each other substantially about a same first axis (38) and with concordant, substantially identical laws of motion, so that, at said cutting station (25), said cutting knife (41) and said pickup member (62) are maintained substantially contacting each other with, in between, a said collar (2) just cut off said strip (24).

2. A method as claimed in claim 1, wherein said pickup member (62) comprises a pickup surface (63) which is brought into contact with said collar (2); said pickup surface (63) being perpendicular to a second axis (50), which is crosswise to said first axis (38) and is maintained, during said cutting step, in a position substantially intersecting said first axis (38).

3. A method as claimed in claim 2, characterized by further comprising a step of rotating said pickup member (62) about said second axis (50) as the pickup member (62) moves downstream from said cutting station (25).

4. A method as claimed in claim 1, wherein said transfer step is performed by means of a transfer wheel (27) rotating continuously about a third axis (28) and comprising at least one arm (42) extending outwards from said transfer wheel (27) and carrying a respective said pickup member (62); said arm (42) being oriented, with respect to said transfer wheel (27), about a fourth axis (45), parallel to said third axis (28), to keep said pickup member (62) substantially stationary at said cutting station (25) during said cutting step.

5. A method as claimed in claim 4, wherein said first, third and fourth axis (38, 28, 45) are parallel.

6. A method as claimed in claim 4, wherein said arm (42) extends along said second axis (50), which is maintained in said position substantially intersecting said first axis (38) by orienting said arm (42) about said fourth axis (45) during said cutting step.

7. A method as claimed in claim 4, characterized by further comprising a supply step, during which said pickup member (62) is fed through a supply station (12) in time with a conveying pocket (13) to feed the respective said collar (2) into the conveying pocket (13) and astride a wrapped group (11) of cigarettes inside the conveying pocket (13); said pickup member (62) being maintained, during said supply step, with the respective second axis (50) oriented in a constantly radial direction with respect to said third axis (28).

8. A method as claimed in claim 1, characterized in that, during said transfer step, said pickup member (62) travels through a pickup station (30) where said collar (2) is assigned a respective coupon (31).

9. A method as claimed in claim 8, characterized in that said pickup member (62) comprises first and second suction means (64, 65) for engaging said collar (2) and said coupon (31) respectively; said first and second suction means (64, 65) being controlled selectively by valve means (53) associated with the pickup member (62).

10. A method as claimed in claim 9, characterized in that said pickup member (62) comprises an inner suction chamber (66); said first and second suction means (64, 65) communicating via respective holes (67, 68) with said chamber (66); said holes (67, 68) being offset along said chamber (66); and said valve means (53) comprising a side valve (69) which engages said chamber (66) in sliding manner and is activated to successively open said holes (67, 68).

11. A method as claimed in claim 10, characterized in that said slide valve (69) is tubular and forms part of a suction circuit (54).

* * * * *